US007263324B2

(12) United States Patent
Takagi et al.

(10) Patent No.: US 7,263,324 B2
(45) Date of Patent: Aug. 28, 2007

(54) HEAT ROLLER, FIXING APPARATUS

(75) Inventors: Osamu Takagi, Chofu (JP); Satoshi Kinouchi, Tokyo (JP); Yoshinori Tsueda, Fuji (JP); Toshihiro Sone, Yokohama (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 218 days.

(21) Appl. No.: 11/078,421

(22) Filed: Mar. 14, 2005

(65) Prior Publication Data

US 2006/0204295 A1 Sep. 14, 2006

(51) Int. Cl.
*G03G 15/20* (2006.01)

(52) U.S. Cl. ..... 399/333

(58) Field of Classification Search ..... 399/330–337; 219/216

See application file for complete search history.

(56) References Cited

U.S. PATENT DOCUMENTS 5,420,395 A * 5/1995 Hyllberg et al. ..... 219/470
6,898,409 B2 5/2005 Tsueda et al.
2004/0175211 A1 9/2004 Sone et al.
2004/0184852 A1 9/2004 Takagi et al.

FOREIGN PATENT DOCUMENTS

JP 01150184 A * 6/1989
JP 04021885 A * 1/1992
JP 8-194400 A 7/1996

OTHER PUBLICATIONS

U.S. Appl. No. 10/805,308, filed Mar. 22, 2004, Yoshinori et al.

* cited by examiner

*Primary Examiner*—David M. Gray
*Assistant Examiner*—Ryan Gleitz
(74) *Attorney, Agent, or Firm*—Foley & Lardner LLP

(57) ABSTRACT

A fixing apparatus according to the invention is provided with a heating roller 1. The heating roller 1 includes an elastic layer 1*b* formed around a shaft member 1*a*, a conductive layer 1*e* formed outside the elastic layer 1*b*, and at least one impedance-adjusting layer 1*d* interposed between the elastic layer 1*b* and the conductive layer 1*e*. The conductive layer 1*e* includes conductive paste containing metal particles.

18 Claims, 3 Drawing Sheets

HEAT ROLLER, FIXING APPARATUS

FIELD OF THE INVENTION

The present invention relates to a fixing apparatus installed in an image forming apparatus, such as a copying machine or a printer, for fixing a developer image on a sheet of paper.

BACKGROUND OF THE INVENTION

An image forming apparatus utilizing a digital technique, such as an electronic copying machine, is equipped with a fixing apparatus for fixing, to a sheet of paper, an image of a melted developer by pressure.

The fixing apparatus comprises a heating member for melting a developer, such as toner, and a pressure member for applying a predetermined pressure to the heating member, a predetermined contact width (nip width) being defined between the contact region (nip portion) of the heating and pressure members. When a sheet of paper with an image of a developer melted by the heating member is passed through the nip portion, the image is fixed on the sheet by pressure from the pressure member.

As a method for heating a heating member using induction heating, it is known to generate a magnetic field by an exciting coil and apply it to a roller-shaped heating member that has an outer periphery formed of a conductive thin film, thereby generating therein an eddy current for heating. In this case, to maintain the rigidity, the conductive thin film is formed of a metal (e.g., nickel).

However, metal films are liable to be oxidized. When the metal film of the heating member, which is formed of, for example, nickel, is heated to 200° C. or more and further pressed by a pressure member, it is degraded due to thermal fatigue and hence cannot be maintained in function over a long period. Further, when it is cooled after heating, the metal film of the heating member may well be broken due to thermal hysteresis, which makes it difficult to maintain the performance of the heating member for a long time.

Further, a heating member is known which has a nickel film formed by electroplating. In this case, thermal degradation of nickel is conspicuous near 200° C., which is a great restriction in use. In addition to this, plating causes problems in manufacturing, such as an inevitable increase in the scale of equipment, difficulty in management of the thickness of plating, and environmental problems concerning liquid wastes.

There is a need for a heating member with a conductive film free from the above problems.

BRIEF SUMMARY OF THE INVENTION

According to an aspect of the present invention, there is provided a heating roller comprising:

a shaft member;

a first elastic layer provided on a longitudinal periphery of the shaft member;

a metal layer provided outside the first elastic layer; and a conductive layer provided outside the metal layer.

According to another aspect of the present invention, there is provided a fixing apparatus comprising:

a heating member including a first elastic layer formed around a shaft member, a conductive layer formed outside the first elastic layer and containing metal particles, and at least one impedance-adjusting layer interposed between the first elastic layer and the metal layer;

a pressure member pressed against the heating member by a pressurizing mechanism; and a heating mechanism which causes the conductive layer to generate heat, using induction heating.

Additional objects and advantages of the invention will be set forth in the description which follows, and in part will be obvious from the description, or may be leaned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the invention will be described in detail with reference to the accompanying drawings.

Figure 1:
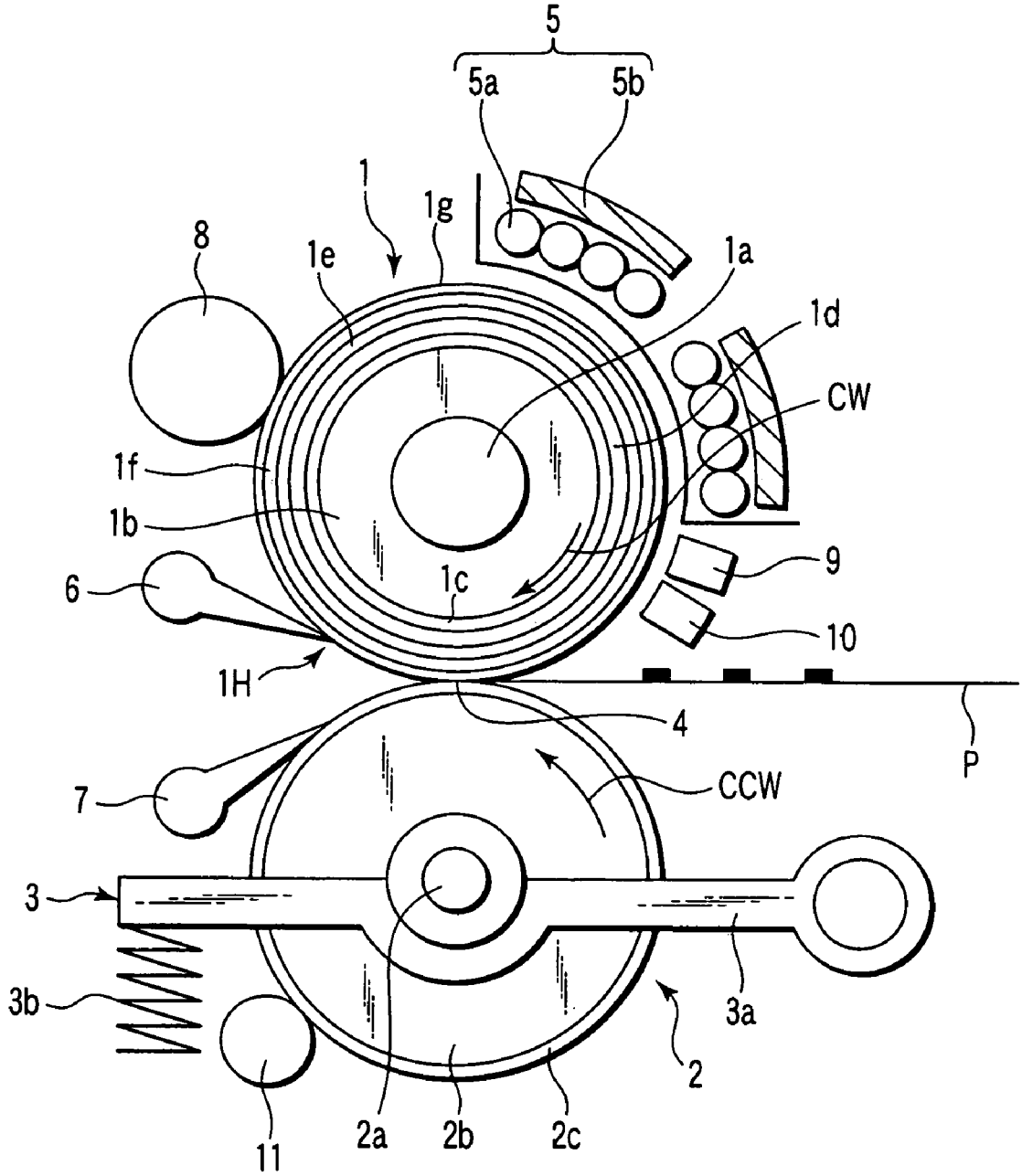
FIG. 1 is a schematic view illustrating an example of a fixing apparatus according to the invention.

FIG. 1 shows an example of a fixing apparatus according to the invention.

As shown in FIG. 1, the fixing apparatus comprises a heating member (heating roller) 1 that can be brought into contact, for heating toner T, with a surface of an image-transferred member, i.e., a paper sheet P, to which toner T sticks. It also comprises a pressure member (pressure roller) 2 for applying a predetermined pressure to the heating roller 1, a pressure mechanism 3 for imparting a predetermined pressure to the pressure roller 2, and a heating mechanism 5 for heating the outer periphery of the heating roller 1 by induction heating.

The heating roller 1 is provided with a shaft member (core member) 1*a* formed of a material of certain rigidity (hardness) that does not deform at a predetermined pressure. It is also provided with an elastic layer (first elastic layer, foam rubber layer, sponge layer) 1*b*, an impedance-adjusting layer (metal layer) 1*c*, a heat-resistive resin layer 1*d*, a conductive layer 1*e* heated by the heating mechanism 5 using induction heating, a solid rubber layer (second elastic layer) if and a mold-releasing layer 1*g*. The elements 1*b* to 1*g* are provided in this order around the shaft member 1*a*. The layers ranging from the impedance-adjusting layer 1*c* to the mold-releasing layer 1*f*, which are provided outside the elastic layer 1*b*, will hereinafter be referred to as "the outer layer portion 1H" (see FIG. 2). The outer layer portion 1H is adhered to the opposite ends of the elastic layer 1*b* by, for example, a heat resistive adhesive.

The pressure roller 2 has a shaft member 2*a*, an elastic member (formed of, for example, silicon rubber) 2*b* and a mold-releasing layer (formed of, for example, fluorocarbon rubber) 2*c*.

The pressure mechanism (pressure-providing mechanism) 3 presses the pressure roller 2 against the heating roller 1 using a pressure spring 3*b*. As a result, a nip portion 4 having a predetermined width (nip width) in the conveyance direction of paper sheets P is formed at the contact portion of the heating roller 1 and pressure roller 2.

The heating roller 1 is rotated by a driving motor (not shown) in the direction indicated by the arrow (CW), with a nip width not less than a certain value kept between the roller 1 and the pressure roller 2 by pressure from the pressure mechanism 3. In accordance with the rotation of the heating roller 1, the pressure roller 2 is rotated in the direction indicated by the arrow (CCW).

A heating mechanism 5, which includes an exciting coil 5*a* for applying a predetermined magnetic field to the conductive layer 1*e* of the heating roller 1, and a magnetic core 5*b* provided outside the exciting coil 5*a*, is provided outside the heating roller 1. The number of windings of the exciting coil 5*a* can be reduced using the magnetic core 5*b*.

When a high-frequency current of a predetermined frequency is supplied from an exciting circuit (inverter circuit), now shown, the exciting coil 5 generates a predetermined magnetic field corresponding to the frequency. During the generation of the magnetic field, an eddy current flows through the conductive layer 1*e*, and the heating roller 1 is heated by the Joule heat generated in accordance with the resistance of the conductive layer 1*e* against the current.

Toner T melted by the heat of the heating roller 1 is fixed on a paper sheet P while the sheet P with toner T sticking thereto is passed through the nip portion 4 between the heating roller 1 and the pressure roller 2, and a predetermined pressure is applied to the sheet by the pressure roller 2.

Each structural element of the heating roller 2 will now be described in more detail.

The conductive layer 1*e* is formed by uniformly coating, with conductive paste, the solid rubber layer 1*f* that serves as its ground layer during film forming, and sintering the resultant structure. The conductive paste is a mixture of resin paste and particles (filler particles) of a metal selected from gold, silver, platinum, copper, aluminum, nickel, stainless steel, a metal compound of aluminum and stainless steel, iron and zinc, etc. The conductive layer 1*e* has a particular magnetic permeability and resistance corresponding to the thickness of the conductive layer 1*e*, and the type of metal contained therein. A current (eddy current) of a predetermined depth of penetration corresponding to the frequency of a current flowing through the exciting coil 5*a* flows through the conductive layer 1*e*. Note that if the conductive layer 1*e* is thinner than the depth of penetration, the magnetic field generated by the exciting coil 5*a* may heat, for example, the shaft member 1*a*, thereby heating the inner portion of the heating roller 1. Further, a magnetic field that is not used for induction heating will be generated, resulting in power loss, i.e., degrading the efficiency of heat generation. However, to reduce the depth of penetration, it is necessary to increase the frequency. In the fixing apparatus that utilizes a frequency falling within a predetermined range, it is difficult to freely set the frequency of the current supplied to the exciting coil 5*a*.

The impedance-adjusting layer 1*c* adjusts the impedance of the entire target to be heated by induction heating, so that the magnetic field of the exciting coil 5*a* can cause induction heating near the outer peripheral surface of the heating roller 1. In the embodiment, the impedance-adjusting layer 1*c* is formed by uniformly coating, with conductive paste, the heat-resistive resin layer 1*d* that serves as its ground layer during film forming, and sintering the resultant structure. The conductive paste is a mixture of resin paste and particles (filler particles) of a metal selected from gold, silver, platinum, copper, aluminum, nickel, stainless steel, a compound of aluminum and stainless steel, iron and zinc, etc.

The elastic layer 1*b* is formed of, for example, foam rubber acquired by foaming silicon rubber. Note that the elastic layer 1*b* is disclosed in prior U.S. patent application Ser. No. 10/886,703 filed Jul. 9, 2004, the entire contents of which are incorporated herein by reference. Accordingly, the elastic layer 1*b* may have a plurality of axially extending air holes for positively discharging, to the outside, the air inside the heating roller 1 to prevent deformation of the heating roller 2 due to thermal expansion. Further, the air holes may be formed of cutouts extending from the outer peripheral surface to the shaft member 1*a*, or of a plurality of holes extending from the outer peripheral surface to the shaft member 1*a*. For the same purpose, the elastic layer 1*b* may be formed of continuous foam. The opposite end faces of the conductive layer 1*e* may have mesh or dot-shaped air holes. In addition, the elastic layer 1*b* may have an axially varied diameter, for example, may be tapered, to form a clearance between the layer 1*b* and the conductive layer 1*e* (or the heat-resistive resin layer 1*d*). It is preferable that the elastic layer 1*b* and the conductive layer 1*e* are not wholly adhered to each other, i.e., only predetermined portions of them are adhered.

The heat-resistive resin layer 1*d* is formed of, for example, a heat resistive resin containing polyimide. The heat-resistive resin layer 1*d* is interposed between the impedance-adjusting layer 1*c* and the conductive layer 1*e*, which include conductive paste, thereby reinforcing the mechanical strength of the outer layer portion 1H of the heating roller 1.

In the embodiment, the diameter of the heating roller 1 and pressure roller 2 is set to 40 mm, the thickness of the elastic layer 1*b* to 5 mm, the thickness of the conductive layer 1*e* to 10 μm, the thickness of the solid rubber layer 1*f* to 200 μm, and the thickness of the mold-releasing layer 1*g* to 30 μm. The solid rubber layer 1*f* is formed of heat resistive silicon rubber and has a function for increasing the adhesion strength of the conductive layer 1*e* and the mold-releasing layer 1*g*. The mold-releasing layer 1*g* is formed of a fluorocarbon resin (PFA, PTFE (polytetrafluoroethylene), or a mixture of PFA and PTFE).

Further, in the embodiment, a laminated layer (hereinafter referred to as "the conductive layer laminated layer), which includes the impedance-adjusting layer 1*c*, heat-resistive resin layer 1*d*, conductive layer 1*d*, solid rubber layer 1*f* and mold-releasing layer 1*g*, may be formed by stacking, on a cylindrical shaft as a base material, the outermost mold-releasing layer 1*g*, the solid rubber layer 1*f*, the conductive layer 1*e*, the heat-resistive resin layer 1*d* and the impedance-adjusting layer 1*c* in this order, and then turning the resultant structure inside out. As mentioned above, the conductive layer 1*e* is formed by uniformly coating the solid rubber layer 1*f* with conductive paste and sintering the resultant structure, and the impedance-adjusting layer 1*c* is formed by uniformly coating the heat-resistive resin layer 1*d* with conductive paste and sintering the resultant structure. However, the conductive layer laminated layer is not limited to this, but may be formed by stacking, on a cylindrical shaft as a base material, the impedance-adjusting layer 1*c*, heat-resistive resin layer 1*d*, conductive layer 1*d*, solid rubber layer 1*f* and mold-releasing layer 1*g* in this order. Namely, the conductive layer 1*e* may be formed by uniformly coating the heat-resistive resin layer 1*d* with conductive paste and sintering the resultant structure.

As can be seen from FIG. 1, a separation blade 6 and cleaning roller 8 are provided around the heating roller 1 downstream, in the direction of rotation, of the nip portion of the heating roller 1 and the pressure roller 2. The separation blade 6 is used to separate each paper sheet P from the heating roller 1, and the cleaning roller 8 is used to remove toner sticking to the heating roller 1. Further, a thermistor 9 and thermostat 10 are provided at a predetermined position in the longitudinal direction of the heating roller 1. The thermistor 9 is used to detect the temperature near the periphery of the heating roller 1, and the thermostat 10 is used to interrupt the supply of power to the exciting coil 5*a* when the surface temperature of the heating roller 1 is increased to an abnormal value.

Around the pressure roller 2, a separation blade 7 for separating each paper sheet P from the pressure roller 2, and a cleaning roller 11 for removing toner sticking to the heating roller 1 are provided.

Alternatively, a plurality of thermistors 9 and thermostats 10 may be provided along the longitudinal direction of the heating roller 1. Similarly, when each paper sheet P is hard to separate, a plurality of separation blades 6 and/or 7 may be provided. In contrast, when each paper sheet P is easy to separate, no separation blades may be employed.

In the embodiment, the exciting coil 5*a* is formed of windings with a central space defined therein, and has an axial length at least longer than the longitudinal paper-passing area (the longitudinal area to be brought into contact with each paper sheet P) of the heating roller 1. The exciting coil 5*a* of this shape can concentrically generate a magnetic flux, thereby enabling the conductive layer 1*c* of the heating roller 1 to locally generate heat.

A Litz wire, which is a bundle of surface-insulated copper wires, is used as the electric wire of the exciting coil 5*a*. The use of a Litz wire as the electric wire of the exciting coil 5*a* enables the coil to generate an effective magnetic field. The embodiment employs a Litz wire formed of eighteen copper wires (polyamide-imide copper wires) that have their surfaces coated with insulating, heat-resistive polyamide-imide and have a diameter of 0.3 mm. However, the invention is not limited to this. A Litz wire formed of nineteen copper wires with a diameter of 0.5 mm, for example, may also be usable.

Further, in the embodiment, a high-frequency current of a frequency of 20 to 50 kHz is supplied from an inverter circuit (not shown) to the exciting coil 5*a*, and the heat value of the heating roller 1 varies within a range of 300 to 1500 W. The frequency of the current supplied from the inverter circuit, not shown, can be set to any arbitrary value, therefore a predetermined frequency, except for a particular frequency range (e.g. 40 kHz, 60 kHz), can be used.

The conductive layer 1*e* formed of conductive paste is superior to a metal film in resistance against bending. Further, the heating roller 1 is mechanically reinforced by the heat-resistive resin layer 1*c*, and sufficiently flexible. Accordingly, even when the heating roller 1 of the invention is heated by induction heating of the heating mechanism 5, and pressed by the pressure roller 2, it is prevented from being excessively degraded due to thermal fatigue or hysteresis, and hence its performance can be maintained for a longer period. This also means that the nip width of the nip portion 4 can be set to a sufficient value, thereby elongating the life of the heating member.

Furthermore, as disclosed in U.S. patent application Ser. No. 10/886,703 incorporated, by virtue of the elastic layer 1*b* having a shape that permits the air inside the heating roller 1 to positively escape to the outside, the heating roller 1 is free from degradation, breakage, changes in shape, hardness, etc., due to thermal hysteresis caused by the difference in thermal expansion rate between the elastic layer 1*b* and the conductive layer 1*e*. As a result, the performance of the heating roller 1 can be maintained at high level for a long period.

Although in the embodiment, the heat-resistive resin layer 1*d* is interposed between the elastic layer 1*b* and the conductive layer 1*e*, the invention is not limited to this. The heat-resistive resin layer 1*d* may be omitted.

If the conductive layer 1*d* is formed of conductive paste containing copper, it becomes liable to be influenced by oxidized coating, which enables the use of, for example, known chemical sintering using supply of copper ions.

In addition, when the fixing apparatus of the invention is installed in an image forming apparatus capable of color copying, the solid rubber layer 1*f* and mold-releasing layer 1*g* are each formed of a material of a higher thermal conductivity in order to increase the area of the nip portion 4.

SECOND EMBODIMENT

Figure 2:
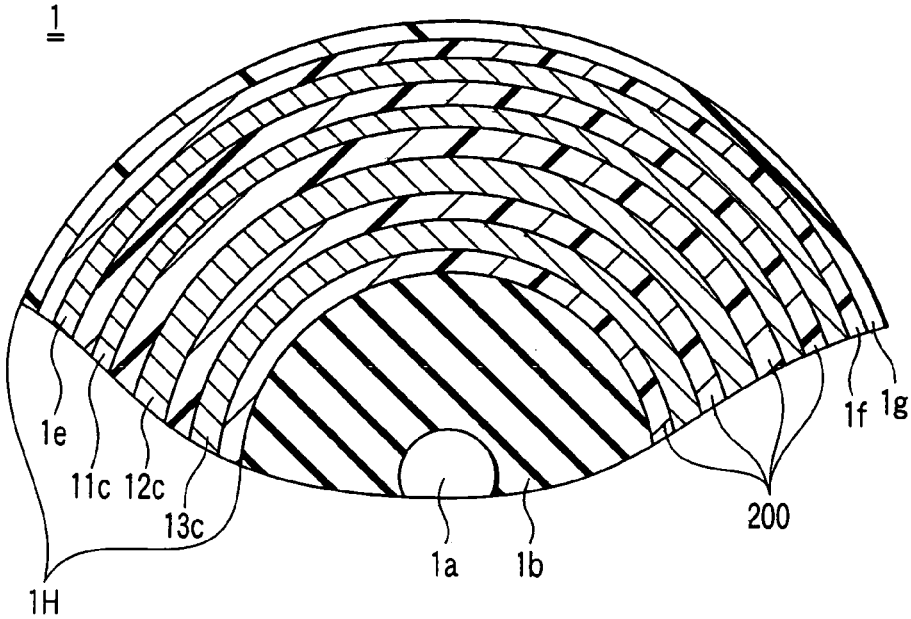
FIG. 2 is a sectional view useful in explaining a roller example that can be used for the fixing apparatus of FIG. 1.

Referring now to FIG. 2, another embodiment of the invention will be described.

As shown in FIG. 2, the heating roller 1 comprises a shaft member 1*a*, an elastic layer 1*b*, a plurality of impedance-adjusting layers 11*c*, 12*c* and 13*c*, a plurality of heat-resistive resin layers 200, a conductive layer 1*e* provided outside the impedance-adjusting layers 11*c*, 12*c* and 13*c*, a solid rubber layer 1*f* and a mold-releasing layer 1*g*. Two of the heat-resistive resin layers 200 are each provided between adjacent ones of the impedance-adjusting layers 11*c*, 12*c* and 13*c*. Elements similar to those in FIG. 1 are denoted by corresponding reference numerals and will be not described in detail.

The impedance-adjusting layers 11*c*, 12*c* and 13*c* are interposed between the elastic layer 1*b* and the conductive layer 1*e*. The first impedance-adjusting layer 11*c*, second impedance-adjusting layer 12*c* and third impedance-adjusting layer 13*c* are arranged in this order, the first impedance-adjusting layer 11*c* being closest to the conductive layer 1*e*.

As well as between adjacent ones of the impedance-adjusting layers 11*c*, 12*c* and 13*c*, the other heat-resistive resin layers 200 are each interposed between the first impedance-adjusting layer 11*c* and the conductive layer 1*e* and between the third impedance-adjusting layer 13*c* and the elastic layer 1*b*.

As described above, the first to third impedance-adjusting layers 11*c*, 12*c* and 13*c* adjust the impedance of a target to be heated by induction heating, so that the magnetic field of the exciting coil 5*a* can cause induction heating near the outer peripheral surface of the heating roller 1. The to-be-heated or heat generation target means a member in which an eddy current flows and hence which is heated (i.e., by induction heating), when the exciting coil 5*a* generate a magnetic field. This target is mainly the conductive layer 1*e*, but includes the first to third impedance-adjusting layers 11*c*, 12*c* and 13*c*, which can also be heated when the exciting coil 5*a* generates a magnetic field.

In this embodiment, the first to third impedance-adjusting layers 11*c*, 12*c* and 13*c* and conductive layer 1*e* are formed to a thickness of 10 μm.

As described above, the heating roller 1 of this embodiment employs the thin conductive layer 1*e* and first to third impedance-adjusting layers 11*c*, 12*c* and 13*c* that are formed of conductive paste. Therefore, the heating roller exhibits high flexibility and hence the nip portion 4 can have a sufficient nip width. This is particularly advantageous when the fixing apparatus of the embodiment is installed in, for example, an image forming apparatus capable of color copying.

Further, the heating roller 1 of this embodiment is constructed such that each of the first to third impedance-adjusting layers 11*c*, 12*c* and 13*c* is held between the heat-resistive resin layers 200, therefore exhibits a great mechanical strength. Furthermore, since the conductive paste forming the first to third impedance-adjusting layers 11*c*, 12*c* and 13*c* has a high resistance against bending, the heating roller exhibits high flexibility.

Accordingly, even when the heating roller 1 of the invention is heated by induction heating of the heating mechanism 5, and pressed by the pressure roller 2, it is prevented from being excessively degraded due to thermal fatigue or hysteresis. Therefore, the performance of the heating roller 1 can be maintained for a longer period, and the nip portion 4 can have a sufficient nip width.

The magnetic permeability levels and resistances of the impedance-adjusting layers 11*c*, 12*c* and 13*c* can be adjusted by changing the rate of content of metal particles contained therein or changing the type of metal. Accordingly, the depth of penetration in the target heated by induction heating due to the magnetic field of the exciting coil 5*a* can be adjusted to a predetermined value. Further, the heat generation target can be adjusted to a thickness equivalent to the depth of penetration corresponding to the exciting coil 5*a* by setting the thickness of the first to third impedance-adjusting layers 11*c*, 12*c* and 13*c* to a predetermined value, or by adjusting the total number of the conductive layer 1*e* and impedance-adjusting layers (11*c*, 12*c*, 13*c*).

For instance, in a fixing apparatus in which the frequency of a current to be supplied to the exciting coil 5*a* is limited to a low range (e.g., 30 kHz or less), the target can be set to a thickness equivalent to the depth of penetration by increasing the thickness of the first to third impedance-adjusting layers 11*c*, 12*c* and 13*c*, or by increasing the number of impedance-adjusting layers (11*c*, 12*c*, 13*c*). Note that if the heat generation target of a thickness corresponding to the depth of penetration is realized by a single layer, sufficient flexibility cannot be acquired, therefore it is difficult to acquire a sufficient nip width.

Thus, by adjusting the number, the thickness and magnetic permeability of impedance-adjusting layers (11*c*, 12*c*, 13*c*), the frequency of the current flowing through the exciting coil 5*a* cab be matched with the depth of penetration in the heat generation target acquired by induction heating resulting from the magnetic field of the exciting coil 5*a*. As a result, the heat generation efficiency of the heating roller 1 can be enhanced.

Thus, the rigidity (hardness) of the heating roller 1 can be adjusted by adjusting the number or thickness of conductive layer 1*e* and first to third impedance-adjusting layers 11*c*, 12*c* and 13*c*. Accordingly, the nip width of the nip portion 4 formed between the heating roller and the pressure roller 2 can be adjusted. This being so, the heating period of each paper sheet P can be controlled. For example, the heating period can be reduced by reducing the thickness of the conductive layer 1*e*, increasing the number of first to third impedance-adjusting layers 11*c*, 12*c* and 13*c*, reducing the hardness of the heating roller 2, increasing the nip width of the nip portion 4, and increasing the passing speed of each paper sheet P.

The first to third impedance-adjusting layers 11*c*, 12*c* and 13*c* can be electrically connected to each other at the axially opposite ends of the heating roller 1. As a result, the thermal conductance of the opposite ends of the heating roller 1 is increased, thereby quickly guiding the thermal energy of the innermost impedance-adjusting layer, i.e., third impedance-adjusting layer 13*c*, of the heating roller 1 to the outermost impedance-adjusting layer, i.e., first impedance-adjusting layer 11*c*. Since the opposite ends of the heating roller 1 are heated by induction heating caused by the respective curved portions of the exciting coil 5*a* opposing the opposite ends, the conventional problem that the temperature of part of the heating roller 1 is reduced can be overcome, i.e., the irregular heat generation of the heating roller 1 can be avoided.

THIRD EMBODIMENT

Figure 3:
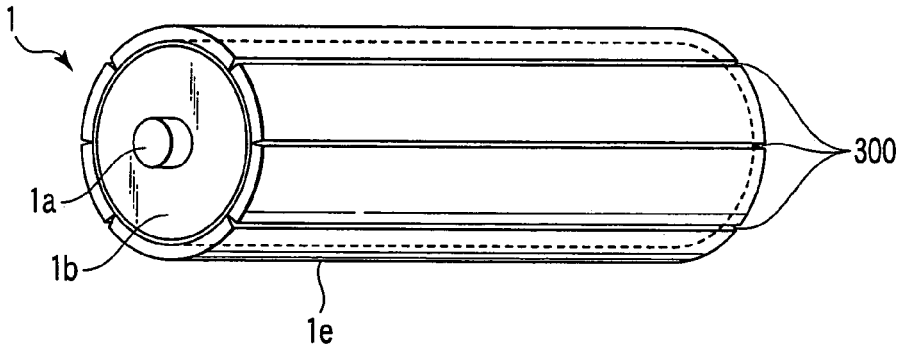
FIG. 3 is a schematic view useful in explaining another roller example that can be used for the fixing apparatus of FIG. 1.
Figure 4:
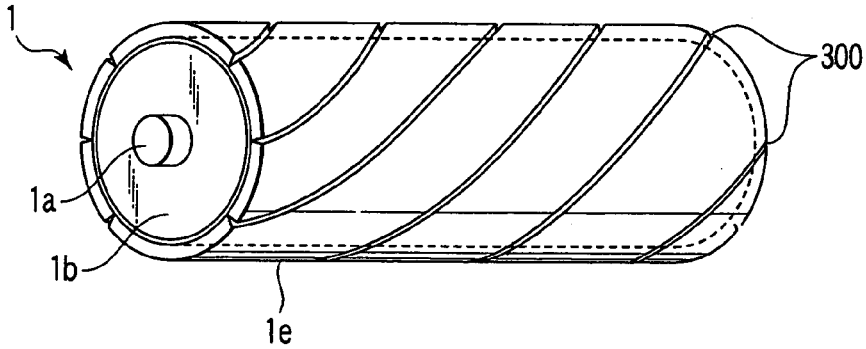
FIG. 4 is a schematic view useful in explaining yet another example of the roller of FIG. 3.
Figure 5:
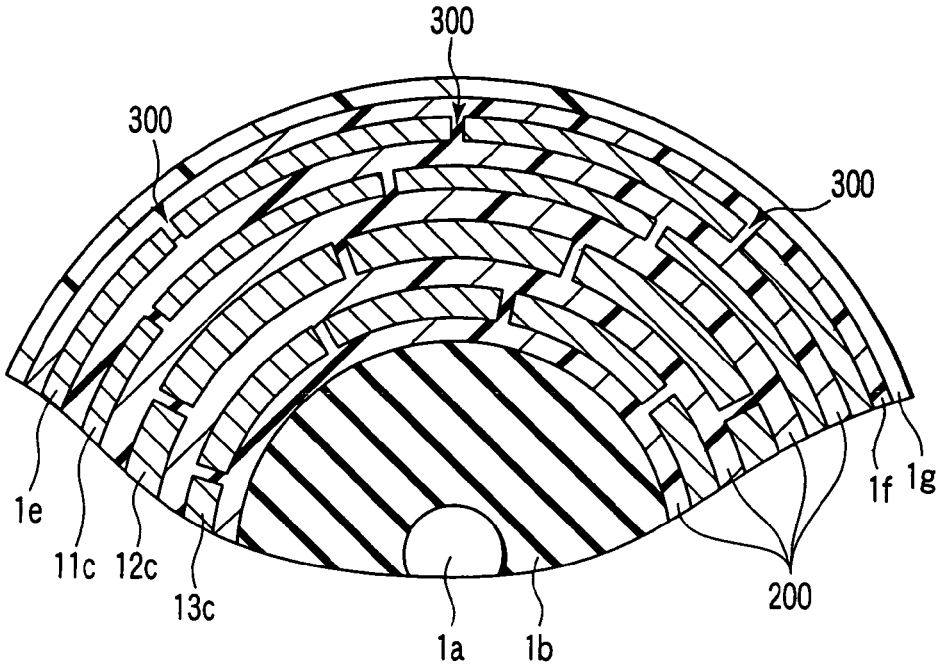
FIG. 5 is a sectional view useful in explaining the roller examples shown in FIGS. 3 and 4.

Referring then to FIGS. 3, 4 and 5, yet another embodiment of the invention will be described.

As shown in FIGS. 3 and 4, the heating roller 1 has grooves 300 that divide at least the conductive layer 1*e*. The grooves 300 may linearly divide the conductive layer 1*e* along the axis of the heating roller 1 as shown in FIG. 3, or may spirally divide the conductive layer 1*e* as the outer peripheral surface of the heating roller 1, as shown in FIG. 4.

Further, as shown in FIG. 5, the grooves 300 are formed in each of the first to third impedance-adjusting layers 11*c*, 12*c* and 13*c*. More specifically, in each of the first to third impedance-adjusting layers 11*c*, 12*c* and 13*c*, the grooves 300 are arranged at positions deviated from each other by a predetermined angle in the thickness direction.

As a result, even if the conductive layer 1*e* is raised from inside by the thermally expanded elastic layer 1*b*, it expands in the circumferential direction of the heating roller 1, whereby generation of cracks or wrinkles in the conductive layer 1*e* is avoided. Furthermore, the circumferential expansion of the conductive layer 1*e* eliminates the problem that the heating roller 2 may be too much hardened because of the difference in thermal expansion rate between the elastic layer 1*b* and the conductive layer 1*e*.

Figure 6:
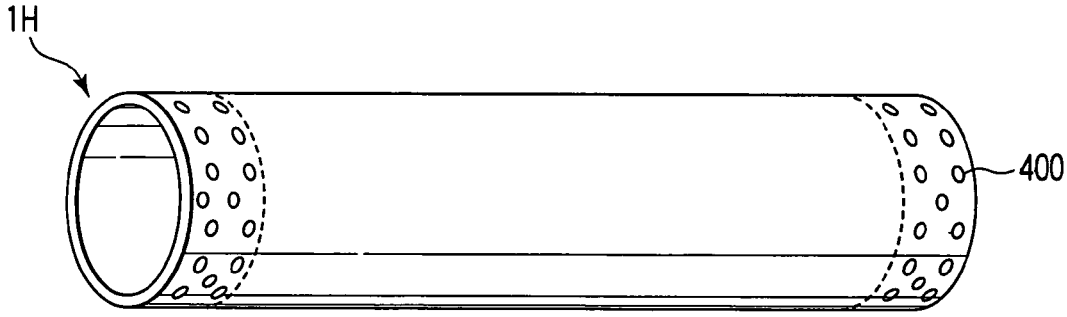
FIG. 6 is a sectional view useful in explaining a further roller example that can be used for the fixing apparatus of FIG. 1.

Furthermore, as shown in FIG. 6, the grooves 300 formed in the conductive layer 1*e* and the first to third impedance-adjusting layers 11*c*, 12*c* and 13*c* are arranged at angularly different positions in the circumferential direction of the heating roller 1, and do not overlap each other in the thickness direction. Accordingly, even if a temperature reduction occurs at a certain groove 300, it is merely a slight ignorable temperature reduction occurring only in the thin conductive layer 1*e* or one of the first to third impedance-adjusting layers 11*c*, 12*c* and 13*c*. This means that a local temperature reduction in the outer peripheral surface of the heating roller 1 is avoided. In other words, irregular heat generation of the outer peripheral surface of the heating roller 1 is prevented.

In order to prevent irregularities from being formed at the surface of each paper sheet P to be brought into contact with the heating roller, no grooves 300 are formed in the solid rubber layer 1*f* or the mold-releasing layer 1*g*. Further, as mentioned above, the conductive layer 1*e* formed of conductive paste is more flexible and hence more resistible against a bending force than a conductive layer formed of a metal. Therefore, the forming of the grooves 300 does not significantly influence the outer peripheral surface of the heating roller 1.

The grooves 100 may be formed by removing predetermined portions of the conductive layer 1*e* by, for example, etching, or simply by cutting out them. Further, each groove 300 may be filled with part of the heat-resistive resin layers 200 as shown in FIG. 6, or may be kept vacant.

FOURTH EMBODIMENT

Figure 7:
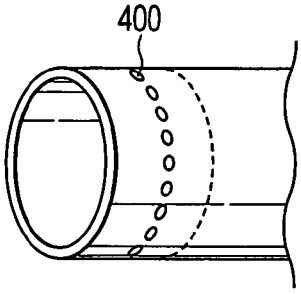
FIG. 7 is a sectional view useful in explaining another example of the roller of FIG. 6.
Figure 8:
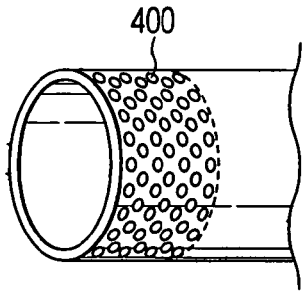
FIG. 8 is a sectional view useful in explaining yet another example of the roller of FIG. 6.

Referring to FIGS. 6, 7 and 8, a further embodiment of the invention will be described.

As shown in FIG. 6, the outer layer portion 1H (see FIG. 2) located outside the elastic layer 1*b* including the conductive layer 1*e* has a plurality of air holes 400 formed in axially opposite end portions thereof.

The air holes 400 are formed in the non-paper-passing areas of the heating roller 1 located at the opposite end portions, and serve to positively guide, to the outside, the air contained in the conductive layer 1*e*. In this embodiment, it is preferable that the air holes 400 are formed in the shape of substantially a circle with a diameter of 1 mm.

Therefore, even if the conductive layer 1*b* is heated and the air therein is expanded, the air is guided to the outside through the air holes 400, thereby preventing the heating roller 2 from being excessively hardened because of the difference in thermal expansion rate between the elastic layer 1*b* and the conductive layer 1*e*. Furthermore, in the paper-passing area, a nit width sufficient for acquiring an image of high quality can be secured.

The outer layer portion 1H is adhered by, for example, a heat-resistive adhesive to part of the outer peripheral surface of the elastic layer 1*b* located inside, so as not to block the air holes 400. Also, it is preferable that the central portions of the outer layer portion 1H and the elastic layer 1*b* are not adhered to each other to define a clearance therebetween.

The air holes 400 may be arranged randomly as shown in FIG. 6, or may be circumferentially aligned as shown in FIG. 7. Alternatively, each opposite end portion may be formed in a mesh as shown in FIG. 8.

In addition, the invention is not limited to the above-described embodiments, but may be modified in various ways without departing the scope. Further, if possible, the embodiments may be combined appropriately. In this case, advantages result from combinations.

For instance, in the embodiments, the heat-resistive resin layer 1*d* shown in FIG. 1 and the heat-resistive resin layers 200 are formed of a heat-resistive resin such as polyimide. However, the invention is not limited to this. For the same purpose as that described in the case of the impedance-adjusting layers, metal particles may be contained therein. In this case, the content of metal particles is set to a value that increases the mechanical strength.

The elastic layer 1*b* may be formed of non-foaming solid rubber.

Further, the pressure roller 2 may comprise an elastic layer, reinforcing layer and conductive layer, like the heating roller 1.

What is claimed is:

1. A heating roller comprising:

a shaft member;

a first elastic layer provided on a longitudinal periphery of the shaft member;

a metal layer provided outside the first elastic layer and configured to adjust an impedance of the heating roller;

a conductive layer which is provided outside the metal layer and which is applied with a magnetic field from outside of the heating roller and generates heat; and a resin layer provided between the metal layer and the conductive layer and providing electrical isolation between the metal layer and the conductive layer.

2. The heating roller according to claim 1, wherein the conductive layer is formed of conductive paste which is a mixture of resin paste and metal particles.

3. The heating roller according to claim 2, wherein the metal particles include particles of at least one selected from the group consisting of gold, silver, platinum, copper, aluminum, nickel, stainless steel, a compound of aluminum and stainless steel, and zinc.

4. The heating roller according to claim 2, wherein the metal layer is formed of conductive paste which is a mixture of resin paste and metal particles.

5. The heating roller according to claim 4, wherein the metal particles include particles of at least one selected from the group consisting of gold, silver, platinum, copper, aluminum, nickel, stainless steel, a compound of aluminum and stainless steel, and zinc.

6. The heating roller according to claim 1, further comprising at least one heat-resistive resin layer provided between the first elastic layer and the metal layer.

7. The heating roller according to claim 1, wherein the metal layer includes a plurality of metal layers and heat-resistive resin layers provided between each pair of adjacent ones of the plurality of metal layers.

8. The heating roller according to claim 7, wherein the plurality of metal layers are each divided in a circumferential direction of the heating roller.

9. The heating roller according to claim 1, wherein at least one of the conductive layer and the metal layer has an axially extending groove.

10. The heating roller according to claim 1, wherein at least one of the conductive layer and the metal layer has a groove extending at a predetermined angle with respect to an axis.

11. A fixing apparatus comprising:

a heating member including a first elastic layer formed around a shaft member, and a conductive layer formed outside the first elastic layer and containing metal particles, and at least one impedance-adjusting layer interposed between the first elastic layer and the conductive layer;

a pressure member pressed against the heating member by a pressurizing mechanism; and a heating mechanism including an exciting coil which applies a magnetic field to the conductive layer to generate heat, using induction heating.

12. The fixing apparatus according to claim 10, wherein the conductive layer is formed of conductive paste which is a mixture of resin paste and metal particles.

13. The fixing apparatus according to claim 12, wherein the metal particles include particles of at least one selected from the group consisting of gold, silver, platinum, copper, aluminum, nickel, stainless steel, a compound of aluminum and stainless steel, and zinc.

14. The fixing apparatus according to claim 12, wherein the at least one impedance-adjusting layer is formed of conductive paste which is a mixture of resin paste and the metal particles.

15. The fixing apparatus according to claim 14, wherein the metal particles include particles of at least one selected from the group consisting of gold, silver, platinum, copper, aluminum, nickel, stainless steel, a compound of aluminum and stainless steel, and zinc.

16. The heating roller according to claim 11, further comprising at least one heat-resistive layer provided between the first elastic layer and the metal layer.

17. The fixing apparatus according to claim 11, wherein at least one of the conductive layer and the at least one impedance-adjusting layer has an axially extending groove.

18. The fixing apparatus according to claim 11, wherein at least one of the conductive layer and the at least one impedance adjusting layer has a groove extending at a predetermined angle with respect to an axis.

* * * * *